US005091046A

United States Patent [19]

Hunter et al.

[11] Patent Number: 5,091,046

[45] Date of Patent: Feb. 25, 1992

[54] CAUSTIC ETCHING OF ALUMINUM WITH MATTE FINISH AND LOW WASTE CAPABILITY

[76] Inventors: Robert F. Hunter, 2351 First Street, Burlington, Ontario, Canada, L7R 1C2; Phillip Hohn, 5 Rannock Street, Toronto, Ontario, Canada, M1L 2N9

[21] Appl. No.: 636,458

[22] Filed: Dec. 31, 1990

[51] Int. Cl.[5] ..... B44C 1/22; C23F 1/00

[52] U.S. Cl. ..... 156/642; 156/665; 156/345; 252/79.5

[58] Field of Search ..... 156/642, 656, 665, 345; 252/79.5; 427/309; 204/33, 38.3, 42; 134/41

[56] References Cited

U.S. PATENT DOCUMENTS

| | | | |
|---|---|---|---|
| 2,795,490 | 6/1957 | Newman et al. | 156/665 |
| 2,795,491 | 6/1957 | Newman et al. | 156/665 |
| 2,975,041 | 3/1961 | Holman | 156/665 |
| 4,372,805 | 2/1983 | Takahashi et al. | 156/642 |
| 4,417,949 | 11/1983 | Lindner et al. | 156/665 |

FOREIGN PATENT DOCUMENTS 1125631 6/1982 Canada .

OTHER PUBLICATIONS

Brown, Craig J., "Regeneration of Caustic Etch Solutions for Aluminum", Plating and Surface Finishing, Jun. 1982.

Kape, J. M., "Chemical Etching of Aluminium in Caustic Soda Based Solutions", Transactions of the Institute of Metal Finishing, 1970, vol. 48, p. 43.

Wernick, J.; Pinner, R.; and Sheasby, P.G., "The Surface Treatment and Finishing of Aluminium and Its Alloys", 1987, pp. 191-203.

Meserve, H. O., Jr., "Chemical Milling Applied to Jet Airliner Body Skins", Plating, Jan. 1969, p. 44.

*Primary Examiner*—William A. Powell

*Attorney, Agent, or Firm*—Rogers, Bereskin & Parr

[57] ABSTRACT

A process for etching aluminum in caustic solution capable of providing a consistently uniform matte finish like that of the never dump process, but with little waste like the regeneration process. Etching is performed in a solution containing free sodium hydroxide and dissolved aluminum in a ratio between about 0.6 and 2.1 g/l and also containing an etch equalizing agent at a temperature above about 70° C. Preferably, the etch solution is regenerated through a crystallization loop.

47 Claims, 7 Drawing Sheets

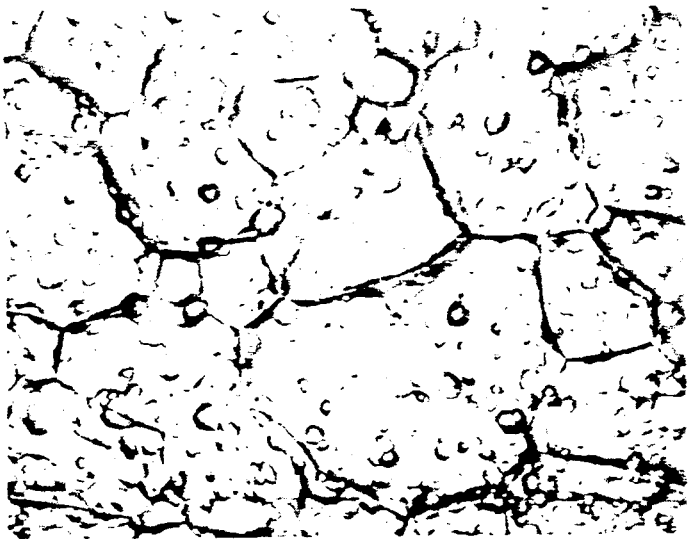
FIG. 1
FIG. 2
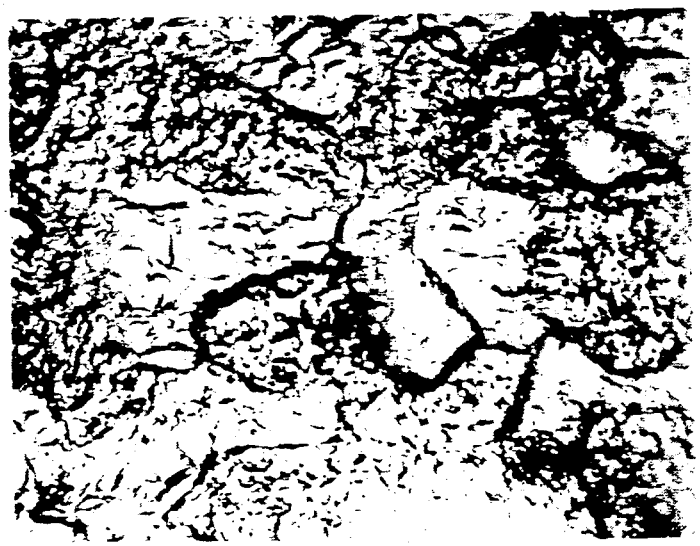
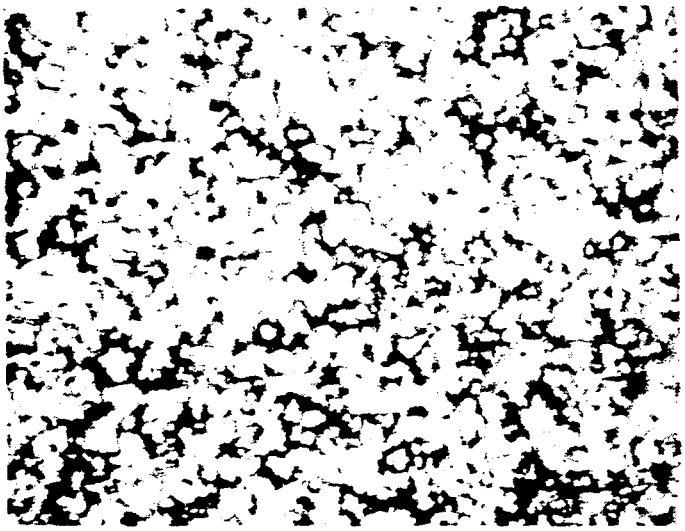
FIG. 3

CAUSTIC ETCHING OF ALUMINUM WITH MATTE FINISH AND LOW WASTE CAPABILITY

FIELD OF THE INVENTION

This invention relates to a process for etching aluminum and aluminum alloys in caustic soda etch solutions.

REVIEW OF RELATED TECHNOLOGY

Work pieces of aluminum and aluminum alloys (hereinafter "aluminum") are often etched in solutions of caustic soda prior to anodizing. Etching produces the basic surface finish which will be visible on the anodized work piece.

During etching, which is conventionally performed at temperatures between about 55° C. and 60° C., sodium hydroxide reacts with the aluminum surface to form sodium aluminate, according to the reaction:

$$2Al+2NaOH+2H_2O \rightarrow 2NaAlO_2+3H_2 \quad (1)$$

If this reaction were simply permitted to continue, the level of dissolved aluminum would rise toward saturation until sodium aluminate would eventually begin to hydrolize, precipitating aluminum hydroxide and liberating free caustic soda, according to the reaction:

$$NaAlO_2+2H_2O \rightarrow Al(OH)_3+NaOH \quad (2)$$

Under typical etch bath conditions, this precipitate would form a hard scale on etch tank walls and heating coils which is very difficult to remove. Simply dumping the etch solution when it reaches aluminum saturation and replacing it with new solution is both wasteful of chemicals and hazardous to the environment.

Two alternative processes are in common commercial use to avoid the precipitation of aluminum hydroxide in the etch tank. In the so called "never dump process" sequestering agents such a sodium gluconate or sorbitol are used to stabilize or "tie up" the aluminum and prevent precipitation. As the aluminum concentration builds up, the etch solution becomes increasingly viscous. Thus, more of the solution adheres to the work pieces when they are removed from the etch tank. Ultimately, so called "drag out" losses of aluminum in the adhering solution balance the rate of aluminum dissolution from etching.

Effluent treatment of water used to rinse the work pieces after etching and disposal of the resulting sludge are major disadvantages of this process. Caustic soda must also be continually added to the etch bath to replace drag out losses in order to continue the etching reaction. Furthermore, etch baths of this process require careful temperature control, which is often difficult, to avoid unwanted precipitation of aluminum hydroxide.

Nevertheless, this process has gained significant commercial acceptance, in part because it can produce high density random micropitting resulting in a uniform matte finish. For many applications, a deep matte finish is preferred to a brighter finish because a matte finish can hide die lines and scratches better than a bright finish.

The other common commercial process, called the "regeneration process", is based on precipitating aluminum hydroxide from the etch solution in a separate chamber and thus preventing precipitation in the etch tank. Typically, the etch solution is regenerated by running a portion of it through a crystallizer containing aluminum hydroxide seed crystals. As aluminum hydroxide is crystallized out, caustic soda is liberated and can thus be recycled to the etch bath. Since the viscosity of the etch solution is low, much lower than that of the never dump process, drag out losses are quite small and only small additions of fresh caustic soda are needed to balance these losses. Waste treatment is also considerably less of a problem.

While this process does not have the major waste product problems of the never dump process, it has unfortunately been found effective to produce only low intensity micropitting resulting in a fairly bright finish. Attempts to obtain a matte finish using this process, particularly on work pieces with significant grain structure such as extrusions, have been generally unsuccessful. Typically, the finish becomes uneven or "galvanized".

SUMMARY OF THE INVENTION

It is a general object of the present invention to provide a consistent and easily controlled finish, including a smooth matte finish when desired, by caustic etching of aluminum with little waste product.

In accordance with the invention, there is provided a process for etching aluminum to obtain a desired finish, which may range from a bright finish to a matte finish, comprising the steps of: contacting the aluminum with a solution containing free sodium hydroxide and dissolved aluminum in a ratio between about 0.6 and 2.1 and also containing an etch equalizing agent at a temperature above about 70° C. and long enough to obtain the desired finish; and subsequently separating the aluminum from the etch solution.

It has surprisingly been found that certain compounds, when added to etch solutions similar to those used in the conventional regeneration process, can reduce or eliminate galvanizing. It has also surprisingly been found that without employing sequestering agents to tie up aluminum, etching at a temperature above about 70° C., in combination with levels of dissolved aluminum generally higher than those used in the conventional regeneration process, can produce a high quality matte finish like that obtained by the never dump process.

Preferably, the ratio of free sodium hydroxide to dissolved aluminum in the etch solution is in the range of about 0.8 to 1.9, and most preferably in the range of about 1.1 to 1.6. Preferably, the concentration of free sodium hydroxide in the etch solution is between about 10 and 50 g/l, more preferably between about 15 and 45 g/l, and most preferably between about 20 and 40 g/l. The etch temperature is preferably between about 70° C. and 85° C., most preferably about 80° C.

In this specification, the term "equalizing agent" means a compound or combination of compounds which promote a substantially uniform rate of etching on the aluminum surface to give a uniform finish. The equalizing agent of the present invention may include sodium nitrate, sodium nitrite, sodium sulfide, triethanolamine, sodium gluconate or sorbitol. Preferably, the equalizing agent includes sodium nitrate, sodium nitrite or sodium sulfide, and most preferably a combination of sodium nitrate and sodium sulfide.

Advantageously, the present invention further includes the step of regenerating the etch solution, preferably by removing a portion of the etch solution, separating dissolved aluminum from that removed portion, and subsequently returning the removed portion to the remainder of the etch solution.

Most preferably, the removed portion is cooled and held in a crystallizer in the presence of seed crystals such that aluminum hydroxide crystallizes out from the solution and free caustic soda is liberated. It has been found that regeneration of the etch solution by means of a crystallization step provides excellent control of the etch bath chemistry, and thereby the degree of etching. This process has very low drag out losses and thus little waste to treat and little make up reagents to add.

The overall advantage is a process which can be easily controlled, and which produces a consistently even finish that can range from bright to matte as desired, with little waste product and low reagent costs.

BRIEF DESCRIPTION OF THE DRAWINGS

In order that the invention may be more clearly understood, reference will be made to the accompanying drawings in which:

FIG. 1 is a photomicrograph of an etched aluminum surface at 200× magnification, showing a sparkle finish;

FIG. 2 is a photomicrograph of an etched aluminum surface at 200× magnification, showing a smutty finish;

FIG. 3 is a photomicrograph of an etched aluminum surface at 200× magnification, showing a smooth matte finish;

DESCRIPTION OF THE INVENTION AND PREFERRED EMBODIMENTS

Figure 4:
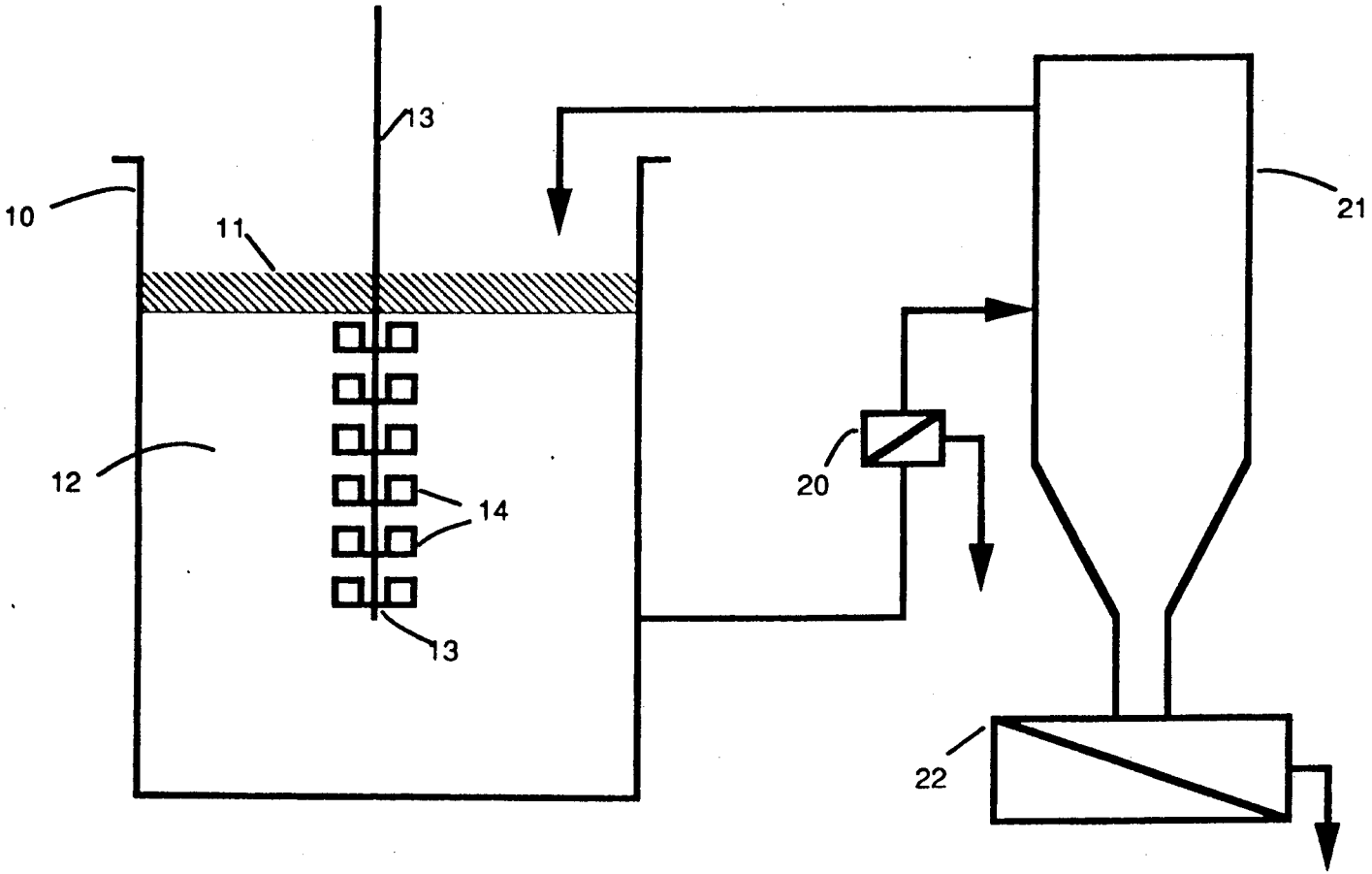
FIG. 4 is a schematic illustration of an etching process according to one embodiment of the invention.

The process of the present invention requires an equalizing agent in the etch solution. The equalizing agent reduces or eliminates selective grain etching, which is known in the trade as "galvanizing". Galvanizing typically causes a rough sparkle finish, and at times a discontinuous smutty appearance.

Compounds which are now identified as effective in reducing or eliminating galvanizing include sodium nitrate, sodium nitrite, sodium sulfide, triethanolamine, and sodium gluconate. Each of these has been found effective, in varying degrees, in reducing the sparkle type of galvanizing shown in FIG. 1 associated with elevated aluminum levels in the etch solution. The sparkle appearance is caused by very deep or total etching away of selective grains, forming reflective steps having depths in the order of about 20 microns. Sodium nitrate was found to be the most effective of these compounds in reducing or eliminating sparkle type galvanizing.

Only sodium sulfide was found to be effective in reducing the smutty type of galvanizing shown in FIG. 2 associated with zinc, which may be present in some aluminum alloys. The smutty appearance is caused by more intense micropitting of selective grains, without being generally as deep or forming reflective steps as found with sparkle type galvanizing. Where the equalizing agent includes sulfide, there will be a tendency to precipitate heavy metal sulfides, and if the process includes regeneration of the etch solution by crystallization, the solution may have to be filtered to remove such heavy metal sulfides prior to crystallization, since they could otherwise "blind" the seed crystals in the crystallizer.

The equalizing agent may include a combination of compounds which are effective in reducing selective grain etching. Triethanolamine, however, should not be combined with sodium nitrate or sodium nitrite, as this combination can present a health hazard. The equalizing agent should also not include sodium gluconate or sorbitol if the process includes regeneration of the etch solution by crystallization.

It has been found that certain compounds identified as effective equalizing agents also have other effects. Sodium nitrate to a small degree enters the etching reaction, dissolving aluminum to form sodium aluminate and ammonia gas, according to the reaction:

$$xNaNO_3+8Al+(8-x)NaOH+(8-2x)H_2O \rightarrow 8NaAlO_2+(12-4x)H_2+xNH_3 \quad (3)$$

It would be expected from the literature that sodium nitrate would dominate this etching reaction. Thus, significant levels of sodium nitrate in the etch solution would be expected to result in the production of large amounts of ammonia gas. However, at the preferred levels of sodium nitrate of the invention, the amount of ammonia gas produced has surprisingly been found to be very small, much less than the amount of hydrogen, and can easily be vented with typical equipment found on etch tanks used to operate the conventional regeneration process.

The sodium nitrate reaction also tends to increase the residual free caustic soda level from what would otherwise be expected, and thus the process can be operated at higher aluminum concentrations without precipitating aluminum hydroxide. This can be advantageous when the process includes regeneration of the etch solution by crystallization, because crystallization is generally more efficient at higher aluminum concentrations. It would be expected in fact that significant levels of sodium nitrate would result in a build up of excess sodium hydroxide. However, it has surprisingly been found that at the preferred levels of sodium nitrate of the invention, the excess sodium hydroxide liberated is low enough just to balance drag out losses.

Sodium sulfide, as well as reducing selective grain etching which causes both sparkle and smutty type galvanizing, also reduces overall etch rates. This can be advantageous since the high etching temperatures of the present invention tend to have relatively fast etch rates. These can be difficult to accommodate in a commercial process due to limitations in manipulation of the work pieces for short residence times.

The conventional regeneration process is typically operated at a temperature between about 55° C. and 60° C., with an aluminum concentration between about 25 and 30 g/l, and a free sodium hydroxide between about 50 and 70 g/l for aluminum. In the present invention, the etch temperature is higher than about 70° C., preferably about 80° C. While the temperature of the etch solution could be as high as its boiling point, at temperatures much above about 85° C. the rate of etch becomes inconveniently fast for commercial applications. The etch reaction is exothermic, and it has been found that operation at about 80° C. facilitates temperature control.

Etching at such high temperatures would be expected to result in so called "transfer stains", that is, streaking of the surface which can occur as a work piece is transferred to a rinse operation after etching. However, it has surprisingly been found that with the etch solutions of the present invention, no transfer stains result during typical commercial transfer times despite the use of etch temperatures above about 70° C.

The ratio of free sodium hydroxide to dissolved aluminum is between about 0.6 and 2.1, and preferably between about 1.1 and 1.6. In the conventional regeneration process, the levels of free sodium hydroxide and dissolved aluminum are typically in a ratio greater than 2:1.

It has been found that the elevated etch temperature and higher aluminum concentration are effective in producing a desirable matte finish, as shown by the microstructure of FIG. 3. Such a matte finish is created by even, random micropits having a frequency in the order of 3000–4000 pits/mm$^2$ and an average depth of about 5 or 6 microns, effectively obliterating grain boundaries. Micropitting for a bright finish would typically have a frequency of only about 500 pits/mm$^2$ and an average depth of about 2 microns. Too low an aluminum concentration will leave residual brightness even at an elevated temperature. However, too high an aluminum concentration will initiate white spotting and streaking. Thus, a fairly well defined aluminum concentration range is required at a temperature above about 70° C. to obtain a high quality matte finish. It has been found that regeneration of the etch solution by crystallization provides a highly satisfactory means for control of the aluminum concentration.

The degree of matte finish obtained at the elevated temperature and within the optimum aluminum concentration range will also depend upon the etch time, which controls the amount of aluminum removed from the surface of the work piece. The elevated etching temperatures of the present invention can raise etch rates to a point where appropriate residence times to produce the desired finish could be rather short for convenient crane manipulation of the work piece. Also, the high gassing rate of hydrogen and caustic mist might cause air quality problems and overflow swelling of the etch bath.

In the present invention, the elevated etch rates which would otherwise be caused by the high etching temperatures are lowered to more conventional ranges by reducing the total caustic concentration. Additionally, the use of small amounts of sodium sulfide can lower the etch rate significantly. Sodium sulfide in concentrations as low as 1 g/l can lower the etch rate by about 25%.

A foaming surfactant may also be employed to create a foam blanket on the etch bath surface, and adhering to the work pieces when they are withdrawn from the etch tank for rinsing. The foam entraps caustic mist and thereby improves air quality, and also reduces heat losses from the etch bath surface at the elevated temperatures.

After etching, the work pieces would typically be rinsed with water. Although the amount of drag out losses of caustic soda and other etch solution chemicals are low, due both to the low visocity and the low concentration levels of the etch solution, the present invention permits some of these losses to be conveniently recovered, and thus reduced even further. At the elevated etch temperatures of the present invention, evaporation of water from the solution can be significant. Water evaporation can be made up from recycled rinse water, thereby reducing chemical losses and also reducing waste treatment.

Without being bound by theory, it is believed that the temperature and concentrations of dissolved aluminum and free sodium hydroxide of the etch solution in the present invention promote the formation of a very thin and porous film of aluminum hydroxide at the interface between the solution and the surface of the work piece. The etch solution attacks the surface through random micropores in this film, leading to intense, evenly distributed micropitting of the surface that is apparent as a matte finish. The high temperature promotes the reaction kinetics so that the aluminum hydroxide film is maintained and does not dissipate away. It is further believed that the equalizing agent evens the thickness and porosity of the aluminum hydroxide film, and thus counteracts the effects of alloy segregation and grain orientation that lead to galvanizing. Thus, the equalizing agent tends to equilibrate the rate of etch and promotes a uniform surface finish.

The present invention, in its broadest scope, could be practised on the basis of dumping and replacing the etch solution when the aluminum concentration becomes too high. However, this would not meet the objective of a low waste product. It is preferred to operate the invention with regeneration of the etch solution to maintain a substantially steady state. Regeneration by ion exchange, dialysis, or other techniques may be effective. It is most preferred though to regenerate the etch solution by continually passing a portion thereof through a crystallizer.

Crystallization removes dissolved aluminum as recoverable aluminum hydroxide crystals, and maintains the aluminum level in the etch solution in the appropriate range. Crystallization can also remove trace levels of heavy metal contaminants by co-crystallization. This can aid in reducing smutty type galvanizing. Crystallization furthermore liberates free sodium hydroxide for the etching process. Where the equalizing agent includes sodium nitrate, additional sodium hydroxide is liberated during crystallization, which can make up for drag out losses.

According to a preferred embodiment of the invention as illustrated in FIG. 4, etching on an architectural anodizing line is performed batchwise. An etch tank 10 contains an etch bath 12 with a foam blanket 11. Extruded aluminum alloy work pieces 14 are cleaned, placed on a rack 13, and then immersed through the foam blanket 11 into the etch bath 12.

The etch bath 12 is a caustic soda solution having about 60 g/l of total sodium hydroxide. Free sodium hydroxide is about 27 g/l, and dissolved aluminum is about 25 g/l. The solution also includes about 12 g/l of sodium nitrate and about 1 g/l of sodium sulfide. The foam blanket 11 is produced by the addition of a foaming surfactant sold under the trademark DOWFAX 2A-1, at a concentration of 0.022 cc./l.

The etch bath 12 is maintained at a temperature of about 80° C. by means of heating coils in the etch tank 10.

The etch is allowed to proceed for the time required to produce the desired degree of etching on the work piece, from a bright finish to a matte finish. For extrusions, an etch time of about 5 minutes has been found effective to produce a smooth matte finish.

After etching, the rack 13 is lifted and the work pieces are allowed to drain for about 10 to 20 seconds, following which they are transported by crane to a rinse tank. After rinsing, the work pieces may be acid desmutted and anodized in a conventional manner.

During etching, a portion of the solution from the etch bath 12 is continually removed and directed to a crystallizer 21, at a rate which is adjusted to maintain a substantially steady state in the etch bath, depending on the surface areas of the work pieces 14, the throughput, and the degree of etch. For example, to produce a matte finish on extruded work pieces at a rate of 100 $m^2$/hr requires continuous regeneration at a rate of approximately 16 l/min.

The removed portion of the etch solution is first passed through a pre-crystallizer filter 20 to remove heavy metal sulfides. The filtered solution is then introduced to the crystallizer 21, which is maintained at about 55° C. by means of a water jacket. The cooling water exiting the water jacket is used for rinsing.

The etch solution enters the crystallizer 21 with about 25 g/l of dissolved aluminum and about 27 g/l of free sodium hydroxide. In the crystallizer 21, aluminum hydroxide crystallizes from the solution on aluminum hydroxide seed crystals. Aluminum hydroxide crystals are continually filtered and removed in a crystallizer filter 22. The aluminum hydroxide recovered from the crystallizer filter 22 can be sold, for example, for use in producing alum. As aluminum hydroxide crystallizes, sodium hydroxide is liberated. Regenerated etch solution is returned from the crystallizer 21 to the etch bath 12 at the same rate at which solution is removed from the etch bath 12 and introduced to the crystallizer 21. The regenerated solution contains about 15 g/l of dissolved aluminum and about 42 g/l of free caustic soda. This maintains the etch bath 12 at a steady state and at the required concentrations of dissolved aluminum and free caustic soda to attain the desired matte finish.

Sodium nitrate is the basic make up chemical. This must be added in an amount of about 0.2 g of sodium nitrate per gram of aluminum dissolved. Nitrate in the solution results in excess caustic liberation in the crystallizer 21. This should approximately balance drag out losses of caustic soda, although slight adjustments with either small amounts of nitric acid or small amounts of sodium hydroxide may be required.

The off gas consists largely of hydrogen, with small amounts of ammonia. Gas evolution can entrain caustic solution as a mist. The foam blanket 11 effectively removes the caustic mist from the off gas.

The invention will now be further illustrated by the following examples which demonstrate the operability and preferred conditions of the process, but which in no way limit the scope of the invention.

EXAMPLE 1

This example shows the effect of a variety of additives in a etch solution at conventional operating temperatures, between 55° C. and 60° C.

Etch baths were prepared generally as "reacted" baths, with the aluminum used to set the initial aluminum concentration being dissolved in a pre-mixed caustic plus additive solution. In this way, a simulation of steady state conditions, with any additive by-products, could better be achieved. The bath was then analyzed by acid titration for total caustic, free caustic and aluminum.

Test pieces of 6063 aluminum alloy extrusions were cleaned for two minutes at 50° C. in a conventional anodizing line cleaner, rinsed, and then immersed on PVC coated wire or PVC plastic racks in a 0.7 l etch bath for a designated time. Temperature was controlled to within +/−1° C. After etching, the pieces were withdrawn from the bath, held in air for 45 seconds to simulate transfer time, rinsed in cold water, de-smutted in either 12% sulphuric or 12% nitric acid for 5 minutes, rinsed again and then dried.

Test pieces were evaluated with respect to surface finish both visually and microscopically. Microscopically, the frequency of random micropits, pit depth, grain boundary etching, and grain to grain differences (galvanizing) were ascertained. Samples were also assessed for stain and macropitting frequency and severity. The overall etch depth or amount of aluminum removed was determined by either weight change or micrometer measurements.

The results are summarized in Table I. From these results it will be noted that of the 19 additives, only sodium nitrate, sodium nitrite, sodium sulfide, sodium gluconate and triethanolamine reduce or eliminate sparkle type galvanizing, and only sodium sulfide reduces or eliminates smutty type galvanizing. None of the additives resulted in a smooth matte surface at an etching temperature of 55° to 60° C.

EXAMPLE 2

This example shows the effects of etch temperature and dissolved aluminum and sodium hydroxide concentrations, with additions of sodium nitrate and sodium sulfide.

Tests were conducted generally as described for Example 1, but in a 150 l etch tank. Total caustic soda concentrations of 60–65 g/l and 105 g/l were tested with varying ratios of aluminum and free caustic soda. Temperatures from 58° C. to 85° C. were tested. The results are shown in Table II. These results show a progressive increase in the degree of matte finish between 70° C. and 83° C. A temperature of at least about 70° C. is required to obtain a satisfactory degree of random microetching to produce a smooth matte finish. The results also show that aluminum concentration at the elevated temperatures has a significant effect on the intensity of the matte finish. Too low an aluminum concentration produces a brighter finish. Too high an aluminum concentration produces visible macropits, namely white spots and flecks. This condition is reduced as the temperature is increased.

For any specific total caustic concentration, there is a fairly well defined optimum range for the aluminum concentration to produce a smooth matte finish at temperatures above 70° C. For example, for a total caustic concentration of 60 g/l, the preferred aluminum concentration is between about 20 and 28 g/l. Such a range of aluminum concentration is compatible with the control range of a tied crystallization regeneration loop.

TABLE I

Effect of various additives on finish at 55° C.-60° C.

| Test | Additive Type | Additive Concentration Range g/l | General Type of Etch Finish* | Galvanizing condition** (i.e., Bright Sparkle Finish and/or Non-Uniform Smut) | Contamination Build-up |
|---|---|---|---|---|---|
| Series 1-1 | Sodium Nitrate | 3.0–40 | Bright, smooth | Eliminate sparkle type | None |
| Series 2-1 | Sodium Nitrite | 3.0–20 | Bright, smooth | Eliminate sparkle type | None |
| Series 3-1 | Sodium Sulfide | 1.0–10 | Bright, smooth | Eliminate sparkle and smut | Sulfate from air oxidation |
| Series 4-1 | Sodium Sulate | 10–25 | Bright | No effect | None |
| Series 5-1 | Sodium Chloride | 10–25 | Bright | No effect | None |
| Series 6-1 | Sodium Fluoride | 1 | Bright | No effect | |
| Series 7-1 | Sodium Molybdate | 1.0–10 | Bright, but modest smoothing re die lines | No effect | |
| Series 8-1 | Sodium Phosphate | 10–30 | Bright, but modest smoothing re die lines | No effect | |
| Series 9-1 | Sodium Gluconate | 10 | Bright | Some reduction in sparkle type | |
| Series 10-1 | Sodium Tartrate | 10 | Bright | No effect | |
| Series 11-1 | Sodium EDTA | 10–40 | Bright | No effect | |
| Series 12-1 | Triethanolamine | 5.0–30 | Bright, smooth | Eliminate sparkle type | |
| Series 13-1 | Dowfax 2A-1 | 0.25–1.0 | Bright | No effect | Foam scum |
| Series 14-1 | Dowfax 3B-2 | 0.25–1.0 | Bright | No effect | Foam scum |
| Series 15-1 | Zinc Sulfate | 0.15–0.50 | Dull, non-uniform smut | Creates smut type | Excessive black smut |
| Series 16-1 | Tin Sulfate | 0.3 | Bright | No effect | Excessive black smut |
| Series 17-1 | Nickel Chloride | 1 | Bright | No effect | |
| Series 18-1 | Copper Chloride | 1 | Bright | No effect | Excessive black smut |
| Series 19-1 | Ammonium Persulfate | 5.0–10 | Bright | Causes deep macro pits | Sulfate |

*Etch Bath - NaOHT = 40–120 g/l, Al = 10 g/l Higher than crystallization final concentration, 55–60° C., 1.0–1.5 mil removal.
**Selective Grain Etch The results also demonstrate that the amount of aluminum removed from the surface of the work piece has a significant effect on the finish, but only at temperatures greater than about 70° C. This degree of control is advantageous for processing a range of alloys that may have different etching responses.

EXAMPLE 3

This example shows the effect of different concentrations of two compounds which may be included in an equalizing agent, namely sodium nitrate and sodium sulfide.

Bench scale tests were employed using a procedure as described for Example 1.

Figure 5:
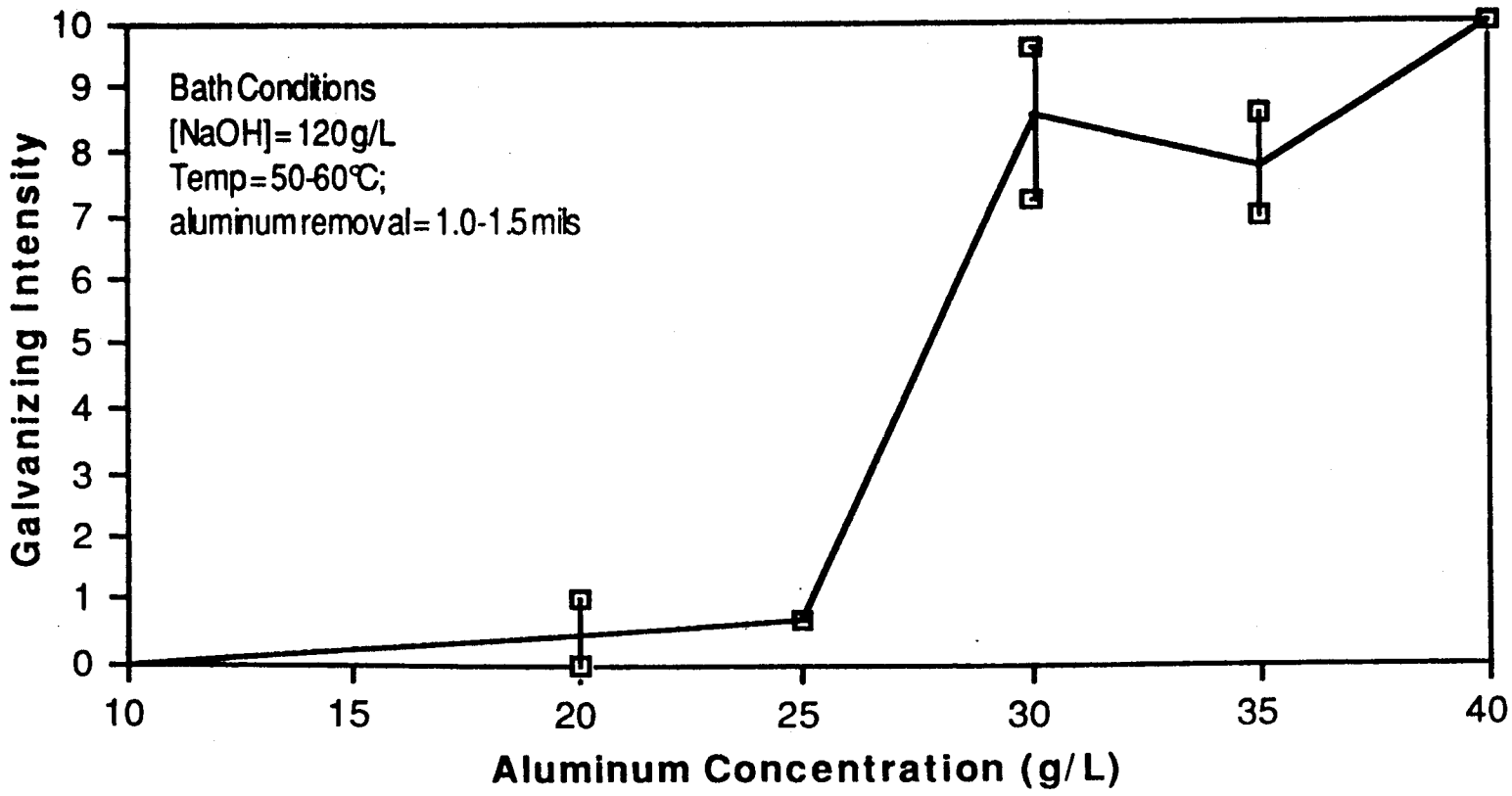
FIG. 5 is a graph of experimental results showing the effect of dissolved aluminum level in the etch solution on etch quality.
Figure 6:
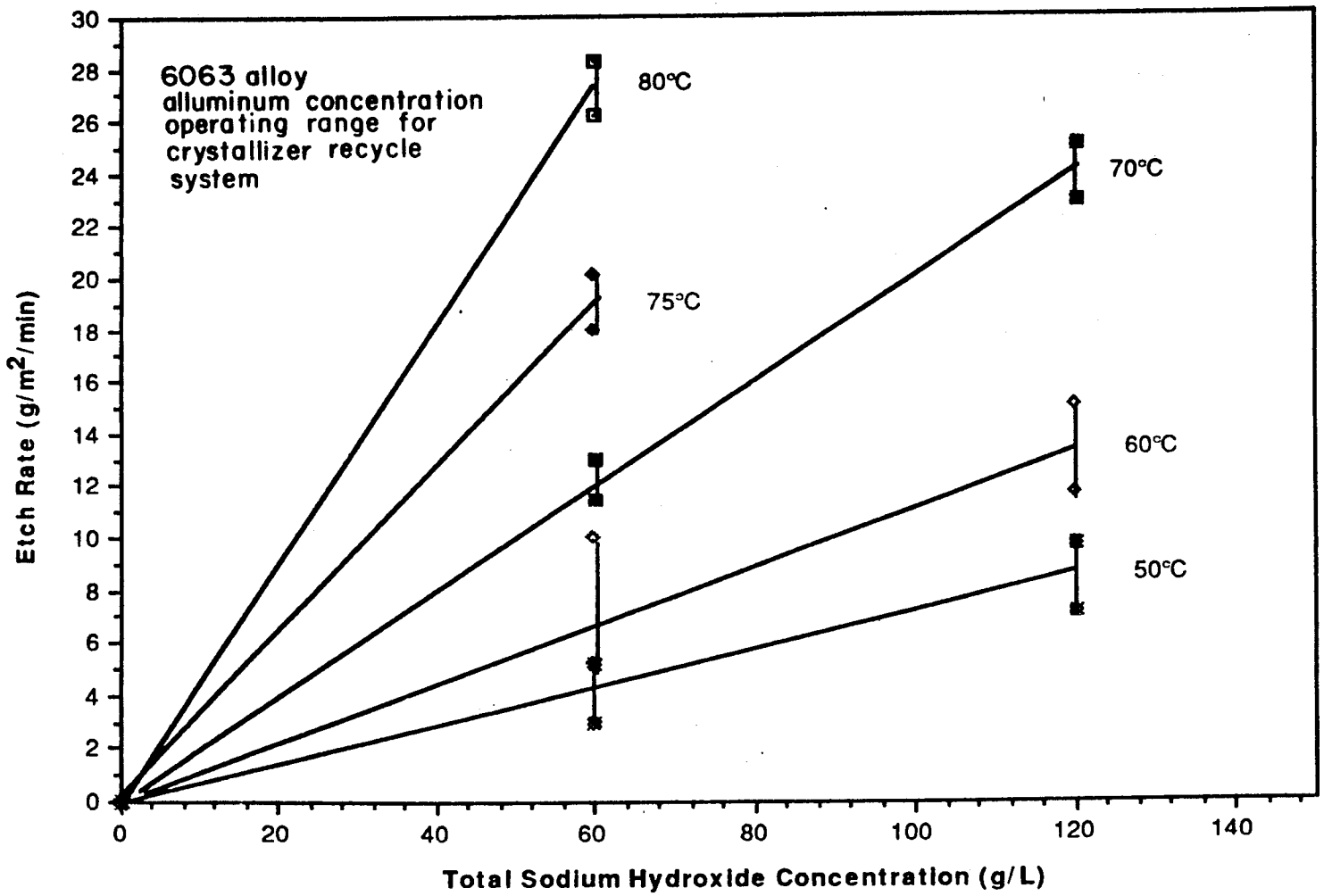
FIG. 6 is a graph of experimental results showing the effect of total sodium hydroxide level in the solution on etch rates at various temperatures.
Figure 7:
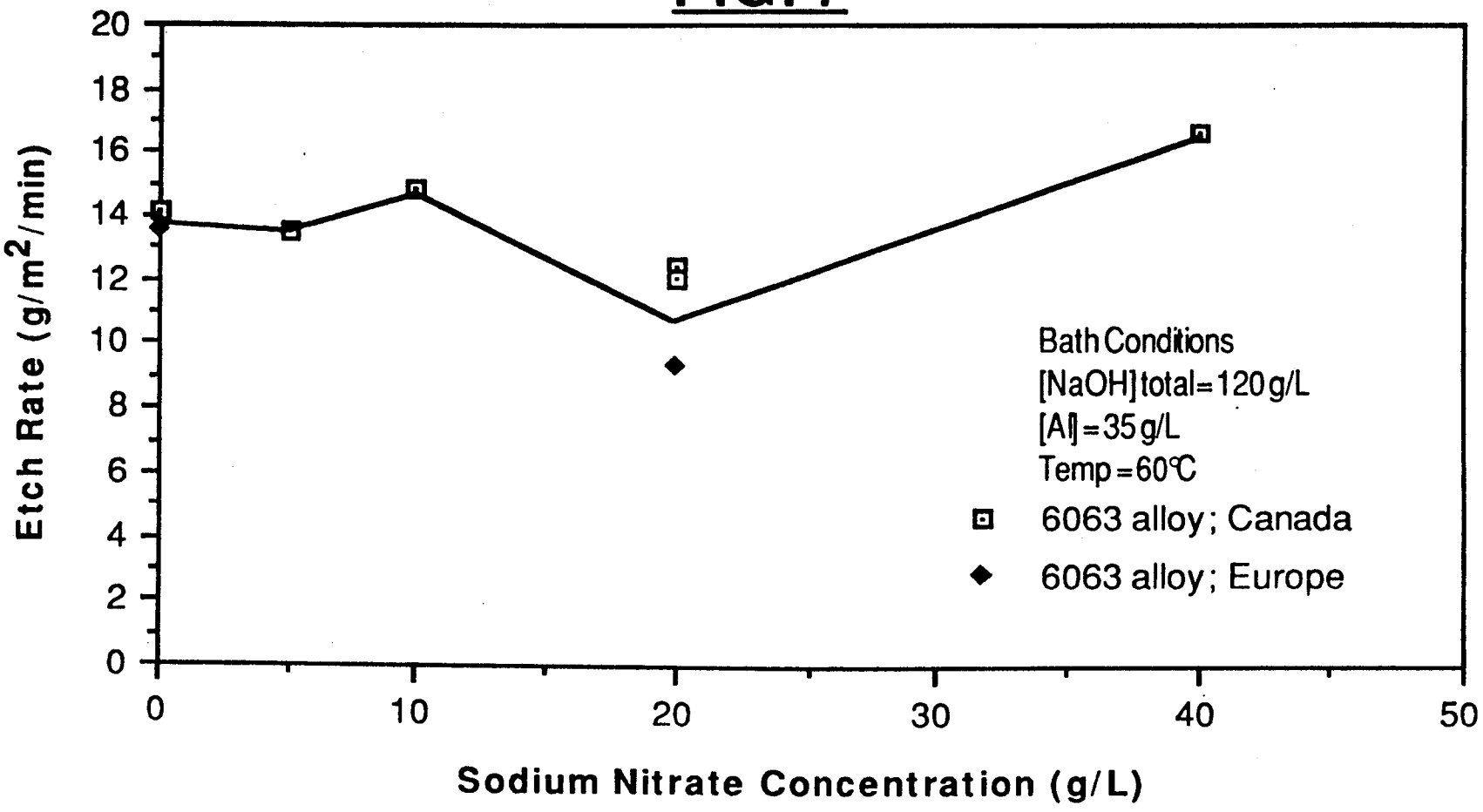
FIG. 7 is a graph of experimental results showing the effect of sodium nitrate level in the etch solution on the etch rate.
Figure 8:
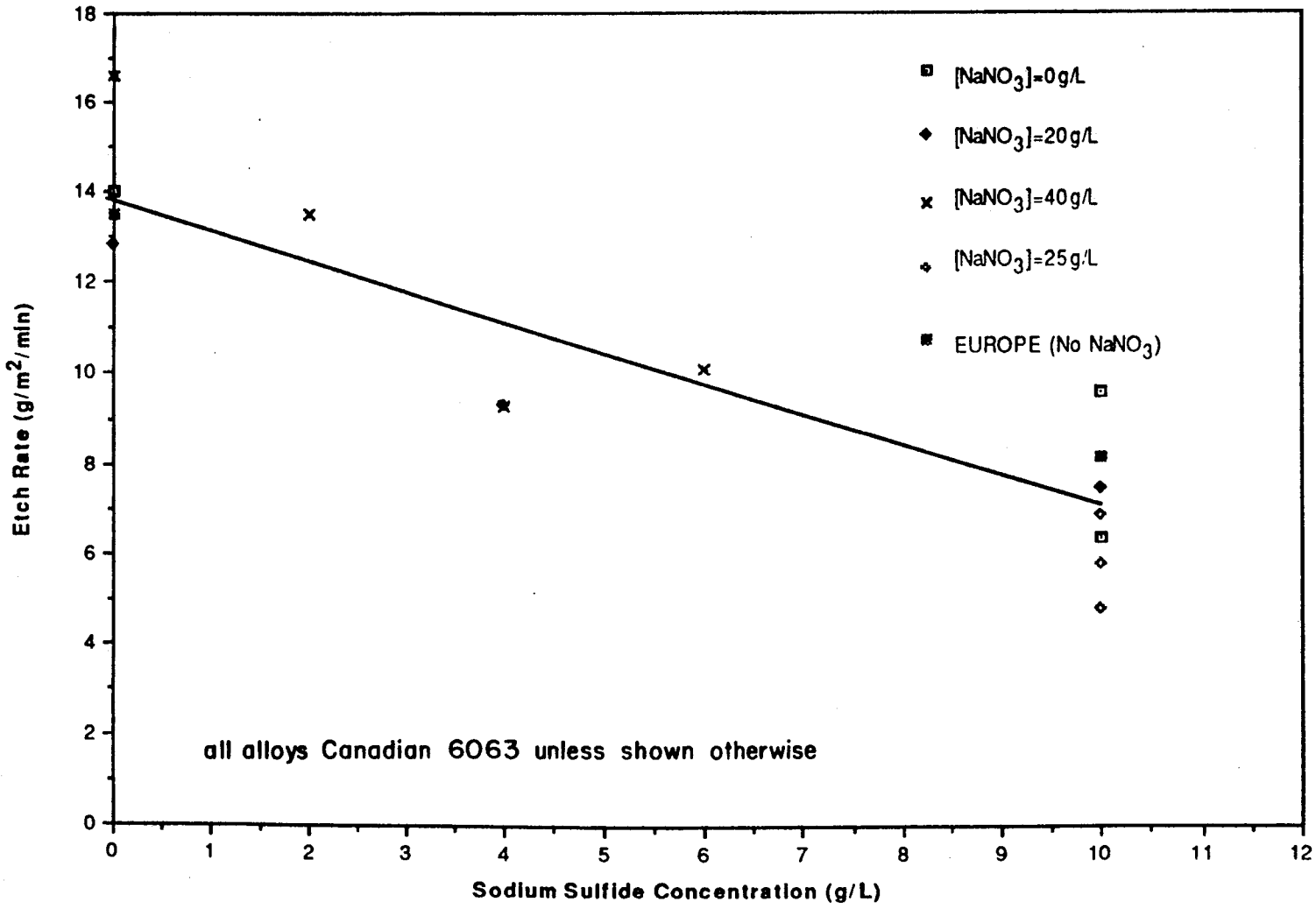
FIG. 8 is a graph of experimental results showing the effect of sodium sulfide level in the etch solution on etch rates.
Figure 9:
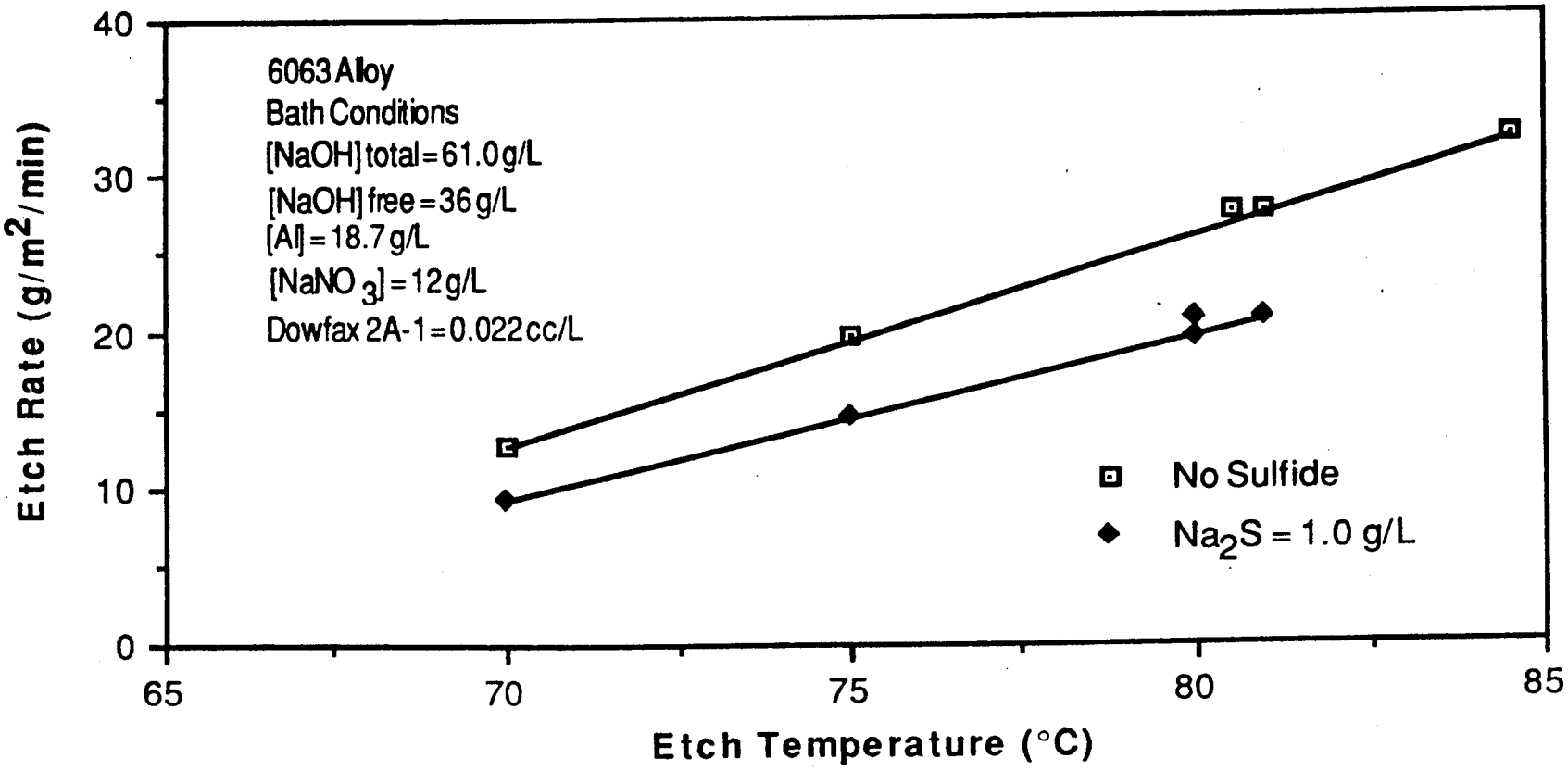
FIG. 9 is a graph of experimental results showing the effect of temperature on etch rates for two etch solutions.

The results are shown in Table III, and in the graph of FIG. 5. These results show that sparkle type galvanizing is caused by elevated aluminum concentrations, and is overcome by sodium nitrate at concentrations above about 5 g/l. The effectiveness of sodium nitrate in reducing or eliminating sparkle type galvanizing is apparent both at conventional temperatures of 50° C., and at the higher temperatures of the present invention. Sodium nitrate is not effective in overcoming smutty type galvanizing. Sodium sulfide does however reduce or eliminate smutty type galvanizing and is effective in concentrations as low as 1 g/l (using a 60% sodium sulfide hydrated commercial reagent). Sodium sulfide can also reduce sparkle type galvanizing, but is not as effective in reducing sparkle type galvanizing as sodium nitrate. Sodium nitrate and sodium sulfide can be used together in order to reduce or eliminate both sparkle type and smutty type galvanizing in concentrations as low as about 5 to 8 g/l sodium nitrate and 0.6 to 1 g/l sodium sulfide.

TABLE II

Effects of temperature and concentrations of aluminum and hydroxide on finish with equalizing agent

| Laboratory Test Run No. | Total NaOH g/l | Free NaOH g/l | Al g/l | Temp. °C. | Al Removed Mils | NaNO3 g/l | Na2S* g/l | Dowfax 2A-1 cc/l |
|---|---|---|---|---|---|---|---|---|
| 1-2 | 105.0 | 75.0 | 20.0 | 58.0 | 1.2 | 20.0 | 10.0 | 10.0 |
| 2-2 | 105.0 | 75.0 | 20.0 | 70.0 | 1.2 | 20.0 | 10.0 | 10.0 |
| 3-2 | 105.0 | 56.0 | 33.0 | 70.0 | 1.2 | 20.0 | 10.0 | 10.0 |
| 4-2 | 105.0 | 75.0 | 20.0 | 83.0 | 1.2 | 20.0 | 10.0 | 10.0 |
| 5-2 | 105.0 | 56.0 | 33.0 | 83.0 | 1.2 | 20.0 | 10.0 | 10.0 |
| 6-2 | 105.0 | 56.0 | 33.0 | 83.0 | 1.4 | 20.0 | 10.0 | 10.0 |
| 7-2 | 105.0 | 56.0 | 33.0 | 83.0 | 1.7 | 20.0 | 0.0 | 10.0 |
| 8-2 | 105.0 | 56.0 | 33.0 | 83.0 | 0.9 | 20.0 | 0.0 | 10.0 |
| 9-2 | 105.0 | 56.0 | 33.0 | 83.0 | 0.7 | 20.0 | 10.0 | 10.0 |
| 10-2 | 60.0 | 29.0 | 21.0 | 70.0 | 1.5 | 12.0 | 1.0 | 0.022 |
| 11-2 | 65.0 | 21.0 | 30.0 | 70.0 | 1.5 | 12.0 | 1.0 | 0.022 |
| 12-2 | 60.0 | 29.0 | 21.0 | 75.0 | 1.5 | 12.0 | 1.0 | 0.022 |
| 13-2 | 65.0 | 21.0 | 30.0 | 75.0 | 1.5 | 12.0 | 1.0 | 0.022 |
| 14-2 | 65.0 | 24.0 | 28.0 | 80.0 | 1.5 | 12.0 | 1.0 | 0.022 |
| 15-2 | 65.0 | 24.0 | 28.0 | 85.0 | 1.5 | 12.0 | 1.0 | 0.022 |

ETCH QUALITY

| Laboratory Test Run No. | Degree of Matte Finish | Die line hiding power | Macro pitting | Stain after de-smut | Micro-structure |
|---|---|---|---|---|---|
| 1-2 | Zero | Zero | None | None | Grain boundary |

TABLE II-continued

| Effects of temperature and concentrations of aluminum and hydroxide on finish with equalizing agent | | | | | |
|---|---|---|---|---|---|
| 2-2 | Fair | Fair | None | None | Grain boundary + modest random micro etch |
| 3-2 | Good | Good | None | None | Grain boundary + modest random micro etch |
| 4-2 | Good | Good | None | None | Grain boundary + modest random micro etch |
| 5-2 | Excellent | Excellent | None | None | Minimum grain boundary: general random micro etch |
| 6-2 | Excellent | Excellent | None | None | Minimum grain boundary: general random micro etch |
| 7-2 | Excellent | Excellent | None | None | Minimum grain boundary: general random micro etch |
| 8-2 | Good | Good | None | None | Grain boundary + medium random micro etch |
| 9-2 | Good+ | Good+ | None | None | Modest grain boundary + medium random micro etch |
| 10-2 | Good | Good | None | None | Modest grain boundary + medium random micro etch |
| 11-2 | Good+ | Some die line pits | Severe | None | Modest grain boundary + medium random micro etch |
| 12-2 | Good+ | Good+ | None | None | Modest grain boundary + medium random micro etch |
| 13-2 | Excellent | Some die line pits | Some pitting | None | Minimum grain boundary: general random micro etch |
| 14-2 | Excellent | Modest die line pits | Modest pitting | None | Minimum grain boundary: general random micro etch |
| 15-2 | Excellent | Excellent | No pitting | None | Minimum grain boundary: general random micro etch |

*commercial hydrated sodium sulfide reagent approx. 60% by weight Na2S

EXAMPLE 4

This example shows the effects of different concentrations of total sodium hydroxide, sodium nitrate and sodium sulfide on etch rates at various temperatures.

Tests were conducted generally as described for Example 1, although some tests were performed in a 150 l etch tank and using aluminum extrusion work pieces having a surface area approximately four times the surface area of the etch bath to simulate typical commercial etching operations.

The results are shown in Table IV, and in the graphs of FIGS. 6–9. These results show that reducing the total caustic concentration by one half reduces the etch rate by approximately one half. Small additions of sodium sulfide also further reduce the etch rate of less concentrated caustic solutions by about 25%. Sodium nitrate has little effect on etch rate. The combination of a total sodium hydroxide concentration of about 60 g/l with 1 g/l of sodium sulfide provides a bath activity at temperatures between about 75° C. and 80° C. only slightly higher than that obtained at 60° C. in an etching solution having a total sodium hydroxide concentration of about 120 g/l as would typically be used in the conventional regeneration process.

The use of a surfactant produced a foam blanket on the etch bath surface which would adhere to the work pieces after their removal from the etch bath and during transfer, significantly reducing evolution of caustic mist. The surfactant employed in these tests was of the anionic diphenyloxide disulfonate type, as manufactured by the Dow Chemical Co., of Midland, Mich., and sold under the trademark DOWFAX 2A-1.

EXAMPLE 5

This example shows the operability of the etching process of the present invention, and resulting surface finish after anodizing.

Etching was conducted in a 450 l etch bath placed adjacent to a commercial anodizing line. Samples were etched in accordance with the invention in a solution containing 64.1 g/l of total sodium hydroxide, 35.2 g/l free sodium hydroxide, 21.6 g/l dissolved aluminum, 12.0 g/l sodium nitrate, 1.0 g/l sodium sulfide and 0.022 g/l DOWFAX 2A-1. The etch temperature was 80° C. and the etch time was 5 minutes, giving approximately 40 microns average metal removal. After etching, the samples were rinsed and acid de-smutted in the usual manner, and then run through the anodizing and sealing operations of the commercial anodizing line.

TABLE III

Effect of concentrations of sodium nitrate and sodium sulfide on finish

| Laboratory Test Run No. | Total NaOH g/l | Free NaOH g/l | Al g/l | Etch Bath Temp. °C. | Al Removed Mils | Surfactant Concentrat. cc/l Dowfax 2A-1 | NaNO3 g/l | Na2S g/l | Zn ppm |
|---|---|---|---|---|---|---|---|---|---|
| 1-3 | 120.0 | 60–90 | 20–40 | 55–60 | 1.2–2.5 | 0.0 | 0.0 | 0.0 | |
| 2-3 | 120.0 | 68.0 | 35.0 | 60.0 | 1.9 | 0.0 | >5.0 | 0.0 | |
| 3-3 | 120.0 | 84.0 | 20.0 | 60.0 | 2.0 | 0.0 | 20.0 | 0.0 | 112.0 |
| 4-3 | 120.0 | 84.0 | 20.0 | 60.0 | 1.5 | 0.0 | 20.0 | 10.0 | 112.0 |
| 5-3 | 105.0 | 75.0 | 20.0 | 60.0 | 1.5–2.0 | 0.0 | 20–30 | 0.0 | <30 |
| 6-3 | 101.0 | 48.0 | 38.0 | 83.0 | 1.7 | 0.0 | 10.0 | 0.0 | 2.0 |
| 7-3 | 101.0 | 45.0 | 38.0 | 83.0 | 1.0 | 3.0 | 10–15 | 0.0 | 2.0 |
| 8-3 | 101.0 | 45.0 | 38.0 | 83.0 | 1.0 | 3.0 | 10–15 | ≧1.0 | 2.0 |
| 9-3 | 60.0 | 28.0 | 21.0 | 80.0 | 1.5 | 0.0 | 0.0 | 0.0 | <2 |
| 10-3 | 60.0 | 30.0 | 20.0 | 80.0 | 2.5 | 0.01 | 0.0 | 1.0 | <2 |
| 11-3 | 60.0 | 23.0 | 25.0 | 80.0 | 1.7 | 0.01 | 0.0 | 4.0 | <2 |
| 12-3 | 60.0 | 23.0 | 25.0 | 80.0 | 1.7 | 0.01 | 12.0 | 4.0 | <2 |
| 13-3 | 60.0 | 23–33 | 18–25 | 80.0 | 1.8 | 0.01 | 12.0 | 1.0 | <2 |
| 14-3 | 61.0 | 36.0 | 18.7 | 80.0 | 2.0 | 0.01 | 12.0 | 0.0 | <2 |

| Laboratory Test Run No. | Galvanizing Intensity and Description |
|---|---|
| 1-3 | Sparkle type with selective grain "step" etch |
| 2-3 | Bright, smooth, no galvanizing |
| 3-3 | Non-uniform, smut type galvanizing. Air sparge streaking. |
| 4-3 | Bright, smooth, no galvanizing |
| 5-3 | Bright, smooth, no galvanizing |
| 6-3 | Matte-satin, desirable finish, no galvanizing |
| 7-3 | Severe, non-uniform smut type galvanizing with selective grain micro etch |

TABLE III-continued

| Effect of concentrations of sodium nitrate and sodium sulfide on finish | |
|---|---|
| 8-3 | Matte-satin, desirable finish, no galvanizing |
| 9-3 | White cast but sparkling and not satin |
| 10-3 | Fairly matte, but areas of sparkle grain "step" galvanizing |
| 11-3 | Matte with fair satin smoothness. Borderline of acceptability. |
| 12-3 | Matte-satin, desirable finish; no galvanizing |
| 13-3 | Matte-satin, desirable finish; no galvanizing |
| 14-3 | Matte-satin, desirable finish; no galvanizing |

The samples were then visually evaluated. The surface finish of the anodized samples was consistently excellent, with a uniform matte appearance like that of anodized work pieces etched by the conventional never dump process.

EXAMPLE 6

This example shows the operability of regenerating etch solutions of the present invention by crystallization.

Etch baths were prepared generally as described for Example 1 and batch type crystallization tests were carried out in 1.5 l stainless steel vessels. The tests were performed at 50° C. for 24 hour periods using 15% by volume seed crystals of non-washed aluminum hydroxide obtained from a commercial crystallization system. An etch solution having a composition typical of that used for the conventional regeneration process, with a total sodium hydroxide concentration of 105 g/l and no added sodium nitrate, sodium sulfide or other equalizing agents, was used as a control.

Crystallization tests were performed with and without pre-filtration. In tests where a high concentration of foaming surfactant was added, a crystal settling aid was added. The settling aid was an anionic polyelectrolyte sold under the trademark ALCHEM 81C09-SC at a concentration of 1 ppm in the etch solution.

The results are shown in Table V. These results show that crystallization rates are not significantly altered by the presence of sodium nitrate, sodium sulfide, or the foaming surfactant, or by the use of a lower total sodium hydroxide concentration than typically used in the conventional regeneration process. Commercial crystallization rates are attainable with the etch solutions of the present invention, and the concentrations of aluminum and free sodium hydroxide in the etch bath can be adjusted by the alteration of the solution flow rate through the crystallization loop.

For example, a lower flow rate through the crystallization loop will cause the dissolved aluminum in the etch bath to increase and the free sodium hydroxide to decrease, while the aluminum removal in crystallization will increase until a new steady state is reached. Where the etch solution includes sodium sulfide, filtration prior to crystallization can remove heavy metal sulfides which could otherwise blind the seed crystals in the crystallizer and thus reduce crystallization rates. Where the etch solution includes sodium nitrate, dissolution of aluminum during etching uses slightly less sodium hydroxide than is liberated during crystallization. The additional liberated sodium hydroxide can make up for drag out losses.

Many modifications of the preferred embodiments described above in detail can be made within the broad scope of the present invention.

TABLE IV

Effect of total caustic concentration on etch rates

| | ETCH BATH CONDITION | | | | | | | | | |
|---|---|---|---|---|---|---|---|---|---|---|
| Lab test run No. | Total NaOH g/l | Free NaOH g/l | Al g/l | Temp °C. | Time Min. | Al Remv. Mils | NaNO3 g/l | Na2S g/l | Dowfax 2A-1 g/l | Etch Rate g Al/m2/min |
| 1-4 | 0-120 | 68-90 | 20-35 | 50-85 | | | 0.0 | 0.0 | 0.0 | See FIG. 6 |
| 2-4 | 120.0 | 68.0 | 35.0 | 60.0 | | | 0-40 | 0.0 | 0.0 | See FIG. 7 |
| 3-4 | 120.0 | 68.0 | 35.0 | 60.0 | | | 0-40 | 0-10 | 0.0 | See FIG. 8 |
| 4-4 | 61.0 | 36.0 | 19-22 | 70-80 | 5-11 | 1.5 | 12.0 | 0-1.0 | 0.022 | See FIG. 9 |
| 5-4 | 105.0 | 64.0 | 28.0 | 60.0 | 8.6 | 1.5 | 0.0 | 0.0 | 0.0 | 12.0 |
| 6-4 | 105.0 | 65.0 | 27.0 | 85.0 | 3.2 | 1.5 | 12.0 | 0.0 | 0.0 | 32.0 |
| 7-4 | 60.0 | 16-29 | 21-30 | 70-80 | 5-14 | 1.5 | 12.0 | 1.0 | 0.022 | 7-20 |

| | GASSING CHARACTERISTICS OF BATH | | | | WORK PIECE TRANSFER CHARACTERISTIC | |
|---|---|---|---|---|---|---|
| Lab test run No. | Surface area of Al / Surface area of tank | Qualitative gassing rate | Foam height cm. | Fume during etch | Fume during transfer | Stain during transfer (after de-smut) |
| 1-4 | | | | | | |
| 2-4 | | | | | | |
| 3-4 | | | | | | |
| 4-4 | | | | | | |
| 5-4 | 4/1 | Normal, controlled | Zero | Moderate | Moderate | Zero |
| 6-4 | 4/1 | Vigorous not controllable | 2.5 (Froth) | Severe | Severe | Zero |
| 7-4 | 4/1 | Normal, controlled | 5.0 (Fine foam) | Low | Moderate except for water vapour | Zero |

TABLE V

Effects of crystallization on etch solution aluminum and free hydroxide concentrations

| TEST | Type of oper. | Total NaOH g/l | Free NaOH g/l | Al g/l | Temp °C. | Time Min. | Al Remv. Mils | NaNO3 g/l | Na2S g/l | Dowfax 2A-1 g/l | Alchem 81 Co9-Sc ppm | NaOH Consumed Al dissolved |
|---|---|---|---|---|---|---|---|---|---|---|---|---|
| | | ETCH BATH CONDITION | | | | | | | | | | |
| Conventional Regeneration Process 1-6 | Lab | 105.0 | 61.2 | 28.7 | 60.0 | 9.4 | 1.5 | 0.0 | 0.0 | 0.0 | 0.0 | 1.5 |
| | | Range | | | | | | | | | | |
| 2-6 | Line | 105.0–130.0 | 60.0–80.0 | 25.0–35.0 | 55.0–60.0 | 7.0–11.0 | 1.0–1.5 | 0.0 | 0.0 | 0.0 | 0.0 | 1.5 |
| Matte-satin finish regeneration process | Lab | 61.0 | 34.1 | 20.1 | 80.0 | 5.0 | 1.5 | 12.0 | 1.0 | 0.022 | 0.0 | 1.3 |
| 3-6 | | 105.0 | 57.4 | 33.8 | 80.0 | 3.3 | 1.5 | 14.0 | 1.0 | 1.0 | 1.0 | 1.4 |

| TEST | Total NaOH Initial g/l | Total NaOH Final g/l | Free NaOH Initial g/l | Free NaOH Final g/l | Al Initial g/l | Al Final g/l | Δ Free NaOH g/l | Δ Al g/l | NaOH Produced Al crystal. | Not NaOH Created g NaOH/g Al Crystallized | Estimated Chemical Make-up g/gAl dissol. | Etch Surface Quality | Anodized Surface Quality |
|---|---|---|---|---|---|---|---|---|---|---|---|---|---|
| | CRYSTALLIZER CONDITIONS | | | | | | | | | | | | |
| Conventional Regeneration Process 1-6 | 105.0 | 103.6 | 61.2 | 72.8 | 28.7 | 20.8 | 11.6 | 7.9 | 1.5 | 0.0 | 0.26 NaOH | Bright sparkle severe die lines | Shiny obvious die lines |
| 2-6 | | | | | | | 14.8 | 10.0 | 1.5 | 0.0 | 0.23–0.35 NaOH | Bright Sparkle severe die lines. Regions of non-uniform smut. | Shiny. Obvious die lines. Non-uniform with dull smut areas. |
| Matte-satin finish regeneration process | 61.0 | 64.3 | 34.1 | 45.3 | 20.1 * 20.1 | 12.7 * 15.5 | 11.2 * 6.8 | 7.4 * 4.6 | 1.5 | 0.2 | 0.03 NaOH 0.36 NaNO3 | Matte-satin minimal die lines | |
| 3-6 | 106.0 | 109.1 | 57.4 | 78.2 | 33.8 | 19.8 | 20.7 | 13.9 | 1.5 | 0.1 | 0.12 NaOH 0.17 NaNO3 | Matte-satin minimal die lines | |

*Indicates not prefiltered

WE CLAIM:

1. A process for etching an aluminum or aluminum alloy work piece to obtain a desired finish from bright to matte, comprising the steps of:

(a) contacting the work piece with a caustic etch solution under the following conditions (i) the etch solution containing free sodium hydroxide and dissolved aluminum in a ratio of between about 0.6 and 2.1 and also containing an etch equalizing agent in an effective amount for producing a substantially uniform etch, (ii) an etch temperature equal to or higher than about 70° C. and less than the boiling temperature of the etch solution, and (iii) an etch time effective for producing the desired degree of etching on the work piece from a bright finish to a matte finish; and (b) subsequently separating the work piece from the etch solution.

2. The process of claim 1, wherein the ratio of free sodium hydroxide to dissolved aluminum in the etch solution is in the range of about 0.8 to 1.9.

3. The process of claim 2, wherein the ratio of free sodium hydroxide to dissolved aluminum in the etch solution is in the range of about 1.1 to 1.6.

4. The process of claim 1, wherein the concentration of free sodium hydroxide in the etch solution is in the range of about 10 to 50 g/l.

5. The process of claim 1, 2 or 3, wherein the concentration of free sodium hydroxide in the etch solution is in the range of about 15 to 45 g/l.

6. The process of claim 4, wherein the concentration of free sodium hydroxide in the etch solution is in the range of about 20 to 40 g/l.

7. The process of claim 1, wherein the etch temperature is in the range of about 70° C. to 85° C.

8. The process of claim 4, wherein the etch temperature is in the range of about 70° C. to 85° C.

9. The process of claim 1, 3 or 6, wherein the etch temperature is about 80° C.

10. The process of claim 1, wherein the etch time is in the range of about 1 minute to 20 minutes.

11. The process of claim 8, wherein the etch time is in the range of about 2 minutes to 11 minutes.

12. The process of claim 3, 4 or 7, wherein the etch time is in the range of about 2 minutes to 11 minutes.

13. The process of claim 1, 8 or 11, wherein the equalizing agent includes sodium nitrate.

14. The process of claim 1, 8 or 11, wherein the equalizing agent includes sodium nitrite.

15. The process of claim 1, 8 or 11, wherein the equalizing agent includes sodium sulfide.

16. The process of claim 1, 8 or 11, wherein the equalizing agent includes triethanolamine.

17. The process of claim 1, 8 or 11, wherein the equalizing agent includes sodium gluconate.

18. The process of claim 1, 8 or 11, wherein the equalizing agent includes sorbitol.

19. The process of claim 1, 8 or 11, wherein the equalizing agent includes a combination of sodium nitrate and sodium sulfide.

20. The process of claim 1, further comprising the step of regenerating the etch solution by separating dissolved aluminum and replenishing sodium hydroxide, such that the free sodium hydroxide and dissolved aluminum in the etch bath are maintained at a substantially steady state.

21. The process of claim 20, wherein the regeneration step includes the steps of removing a portion of the etch solution, separating dissolved aluminum from said portion, and subsequently returning said portion to the remainder of the etch solution.

22. The process of claim 21, wherein the step of separating dissolved aluminum from the removed portion of the etch solution includes the step of cooling said portion and holding in the presence of seed crystals such that aluminum hydroxide crystallizes from the solution.

23. The process of claim 1, 8 or 11, wherein the etch solution is regenerated while repeating steps (a) and (b) by:

(c) removing a portion of the etch solution;

(d) cooling the removed portion and holding in a crystallizer in the presence of seed crystals such that an aluminum hydroxide containing solid product is formed, thereby reducing the concentration of dissolved aluminum and increasing the concentration of free sodium hydroxide in the removed portion of the etch solution to yield a regenerated caustic solution having a ratio of free sodium hydroxide to dissolved aluminum greater than that of the remainder of the etch solution;

(e) separating the regenerated caustic solution from the solid product;

(f) returning the separated, regenerated caustic solution to the remainder of the etch solution;

steps (c)–(f) being performed in a continual loop such that the etch solution is maintained at a substantially steady state.

24. The process of claim 1, wherein the step of contacting the work piece with a caustic etch solution includes immersing the work piece in an etch bath, and wherein the etch solution is regenerated while repeating steps (a and (b) by:

(c) removing a portion of the etch solution from the etch bath;

(d) cooling the removed portion to a temperature less than about 65° C. and holding in a crystallizer in the presence of aluminum hydroxide seed crystals such that an aluminum hydroxide containing solid product is crystallized from the removed portion of the etch solution, thereby reducing the concentration of dissolved aluminum and increasing the concentration of free sodium hydroxide in the removed portion to yield a regenerated caustic solution having a ratio of free sodium hydroxide to dissolved aluminum greater than that of the etch solution in the etch bath;

(e) separating the regenerated caustic solution from the solid product;

(f) returning the separated regenerated caustic solution to the etch bath;

the concentrations of sodium hydroxide and dissolved aluminum being such that aluminum hydroxide crystallizes only in the presence of seed crystals in the crystallizer, and steps (c)–(f) being performed in a continual loop such that the concentrations of sodium hydroxide and dissolved aluminum of the etch solution in the etch bath are maintained at a substantially steady state.

25. The process of claim 20, 21 or 22, wherein the ratio of free sodium hydroxide to dissolved aluminum in the etch solution is the range of about 0.8 to 1.9.

26. The process of claim 24, wherein the ratio of free sodium hydroxide to dissolved aluminum in the etch solution is in the range of about 0.8 to 1.9.

27. The process of claim 20, 21 or 22, wherein the concentration of free sodium hydroxide in the etch solution is in the range of about 10 to 50 g/l.

28. The process of claim 20, 21 or 22, wherein the concentration of free sodium hydroxide in the etch solution is in the range of about 15 to 45 g/l.

29. The process of claim 24, wherein the concentration of free sodium hydroxide in the etch solution is in the range of about 15 to 45 g/l.

30. The process of claim 20, 21 or 22, wherein the etch temperature is in the range of about 70° to 85° C.

31. The process of claim 24, wherein the etch temperature is about 80° C.

32. The process of claim 29, wherein the etch temperature is in the range of about 70° to 85° C.

33. The process of claim 20, 21 or 22, wherein the etch time is in the range of about 1 minute to 20 minutes.

34. The process of claim 32, wherein the etched time is in the range of 2 minutes to 11 minutes.

35. The process of claim 26, 29 or 32, wherein the etch time is in the range of about 2 minutes to 11 minutes.

36. The process of claim 20, 24 or 34, wherein the equalizing agent includes sodium nitrate at a concentration in the range of about 5 to 20 g/l.

37. The process of claim 20, 24 or 34, wherein the equalizing agent includes sodium nitrite at a concentration in the range of about 5 to 20 g/l.

38. The process of claim 20, 24 or 34, wherein the equalizing agent includes sodium sulfide at a concentration in the range of about 0.5 to 6 g/l.

39. The process of claim 20, 24 or 34, wherein the equalizing agent includes triethanolamine at a concentration in the range of about 5 to 30 g/l.

40. The process of claim 20 or 21, wherein the equalizing agent includes sodium gluconate.

41. The process of claim 20 or 21, wherein the equalizing agent includes sorbitol.

42. The process of claim 24, wherein the equalizing agent includes a combination of sodium nitrate at a concentration in the range of about 5 to 20 g/l and sodium sulfide at a concentration in the range of about 0.5 to 6 g/l.

43. The process of claim 24, 34 or 42, further comprising the step of recovering the aluminum hydroxide containing solid product after the regenerated caustic solution is separated therefrom.

44. The process of claim 24, 34 or 42, wherein the etch solution contains heavy metal sulfides and wherein the process further comprises the step of substantially separating such heavy metal sulfides from said removed portion of etch solution prior to cooling said removed portion in a crystallizer

45. The process of claim 24, 34 or 42, wherein the etch solution contains heavy metal sulfides and wherein the process further comprises the step of substantially separating such heavy metal sulfides from said removed portion of etch solution by filtration.

46. The process of claim 1, 24 or 42, further comprising the step of rinsing the work piece after separating it from the etch solution, and wherein a portion of the rinse water is added to the etch solution substantially to balance evaporation and drag out losses.

47. The process of claim 24, 34 or 42, wherein the etch solution further comprises an anionic surfactant in an effective amount for producing a foam blanket on the etch bath.

* * * * *